US006984275B1

(12) United States Patent
Walsh et al.

(10) Patent No.: US 6,984,275 B1
(45) Date of Patent: Jan. 10, 2006

(54) REDUCED EROSION ADDITIVE FOR A PROPELLING CHARGE

(75) Inventors: Christine Marie Walsh, Waldorf, MD (US); Christine Dianne Knott, Waldorf, MD (US); Charles Stanley Leveritt, Jarrettsville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 42 days.

(21) Appl. No.: 10/364,333

(22) Filed: Feb. 12, 2003

(51) Int. Cl.
*C06B 45/10* (2006.01)
*C06B 25/34* (2006.01)

(52) U.S. Cl. ..... 149/19.7; 149/92

(58) Field of Classification Search ..... 149/19.7, 149/19.8, 45, 92
See application file for complete search history.

(56) References Cited

U.S. PATENT DOCUMENTS

| | | | | | |
|---|---|---|---|---|---|
| 3,194,851 | A | * | 7/1965 | Sauer et al. | 149/3 |
| 3,362,382 | A | | 1/1968 | Katz | 102/38 |
| 3,392,669 | A | | 7/1968 | Picard | 102/38 |
| 3,392,670 | A | | 7/1968 | Picard | 102/38 |
| 3,397,636 | A | | 8/1968 | Jacobson | 102/38 |
| 3,707,411 | A | * | 12/1972 | Gawlick et al. | 149/19.8 |
| 3,739,574 | A | * | 6/1973 | Godfrey | 60/219 |
| 3,954,528 | A | * | 5/1976 | Chang et al. | 149/19.4 |
| 3,969,166 | A | | 7/1976 | Sayles | 149/19.4 |
| 3,979,236 | A | | 9/1976 | Sayles | 149/19.8 |
| 4,013,596 | A | * | 3/1977 | Einberg | 149/19.1 |
| 4,180,424 | A | * | 12/1979 | Reed et al. | 149/19.4 |
| 4,334,477 | A | | 6/1982 | Axelrod | 102/435 |
| H18 | H | | 2/1986 | Bracuti | 102/435 |
| 4,689,097 | A | * | 8/1987 | Jones | 149/21 |
| 4,843,121 | A | * | 6/1989 | Gilbert | 149/19.91 |
| 5,125,684 | A | * | 6/1992 | Cartwright | 149/19.7 |
| 5,151,557 | A | | 9/1992 | Bracuti | 102/435 |
| 5,205,983 | A | * | 4/1993 | Camp et al. | 149/97 |
| 5,256,792 | A | * | 10/1993 | Lee et al. | 149/36 |
| 5,487,798 | A | * | 1/1996 | Williams | 149/22 |
| 5,487,851 | A | * | 1/1996 | Dillehay et al. | 264/3.3 |
| 5,500,060 | A | * | 3/1996 | Holt et al. | 149/19.1 |
| 5,581,928 | A | | 12/1996 | Krumm | 42/76.01 |
| 5,711,546 | A | * | 1/1998 | Hamilton et al. | 280/736 |
| 5,712,445 | A | | 1/1998 | Kassuelke | 102/288 |
| 5,716,557 | A | * | 2/1998 | Strauss et al. | 149/19.6 |
| 6,024,812 | A | * | 2/2000 | Bley et al. | 149/92 |
| 6,145,876 | A | * | 11/2000 | Hamilton | 280/736 |
| 6,228,191 | B1 | * | 5/2001 | Leenders | 149/19.6 |
| 6,228,192 | B1 | * | 5/2001 | Neidert et al. | 149/19.8 |
| 6,508,894 | B1 | * | 1/2003 | Beaupre et al. | 149/19.4 |

* cited by examiner

*Primary Examiner*—Aileen Felton
(74) *Attorney, Agent, or Firm*—Fredric J. Zimmerman

(57) ABSTRACT

The present invention comprises an additive to a propelling charge that greatly reduces barrel erosion when used in a gun system compared to the current additives noted above. The invention provides both a high nitrogen to carbon monoxide ratio in the combustion products of the propelling charge in conjunction with a reduced flame temperature which both work to reduce gun-barrel erosion.

11 Claims, No Drawings

REDUCED EROSION ADDITIVE FOR A PROPELLING CHARGE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains generally to the field of reducing gun barrel erosion for firearms and larger gun-type systems and more particularly to propellant additives to be used for this purpose.

2. Description of the Related Art

Gun barrel erosion has been a problem since the development of gun systems. Due to high flame temperatures created by the propelling charges within gun systems, barrel erosion is inevitable. As propelling charges have been developed that produce greater range and velocities for gun systems, the barrel erosion problem has increased.

Several different methods have been developed to address this problem. First, different barrel designs have been developed to reduce erosion. U.S. Pat. No. 5,712,445 discloses a barrel having cool-burning segments of the barrel stratified with hot-burning segments in order to reduce erosion. A problem associated with such systems is the cost involved in creating such complex systems as well as a decrease in system performance.

Second, many liners or additives have been developed that are deployed within the barrel to reduce erosion. U.S. Pat. No. 5,581,928 discloses an electrically non-conductive lining extending along the length portion of a barrel to reduce erosion. U.S. Pat. No. 3,397,636 discloses a powdery metal-containing inorganic substance that resists erosion placed on the inside of the barrel. U.S. Pat. No. 3,362,328 discloses fibers of polyester, acrylic, silk, wool, glass, and asbestos incorporated into a wax containing calcium sulfate, calcium carbonate, and/or titanium oxide formed into sheets and placed within the barrel to reduce erosion. The problem associated with the above type systems is that reducing the useable area with a gun system decreases performance.

Third, coatings have been developed to apply directly to the propelling charge in order to reduce erosion. U.S. Pat. No. 5,151,557 discloses coating a propelling charge with a composition of sodium or potassium water glass and a volatile flash suppressant of $NH_4HCO_3$, $(NH_4)_2CO_3$, and/or $KHCO_3$. U.S. Pat. No. 4,334,477 discloses using sheets of an additive comprising a mixture of a super water absorbent starch modified polyacrylonitrile which has been subjected to alkaline saponification and water in conjunction with a propelling charge. U.S. Pat. Nos. 3,392,669 and 3,392,670 disclose coating a propelling charge with substances such as feldspar, kaolin, kaolinite, or talc. U.S. SIR HI18 discloses coating a propelling charge with ammonium or potassium carbonates or a bicarbonate. One problem associated with coating propellants is that the coating reduces performance of the propelling charge with minimal erosion gains.

Lastly, new propelling charge compositions have been developed that produce a lower flame temperature, and, thereby, reduce barrel erosion. U.S. Pat. Nos. 3,969,166 and 3,979,236 disclose using a small percentage of a silicate within a propellant charge to reduce the erosive burning of the propellant. However, introducing such materials into a propellant composition have the effect of reducing the performance of the propellant with relatively minor erosion gains.

Therefore, it is desired to provide an additive to a propelling charge composition that greatly reduces gun barrel erosion without significantly reducing the performance of the propelling charge composition.

SUMMARY OF THE INVENTION

The present invention comprises an additive to a propelling charge that greatly reduces barrel erosion when used in a gun system compared to the current additives noted above. The invention provides both a high nitrogen to carbon monoxide ratio in the combustion products of the propelling charge in conjunction with a reduced flame temperature which both work to reduce gun-barrel erosion.

It is an object of this invention to provide an improved propelling charge for gun systems to reduce gun-barrel erosion compared to current propelling charges.

It is a further object of this invention to provide a reduced erosion propelling charge for gun systems that does not significantly reduce the performance of the propelling charge.

This invention accomplishes these objectives and other needs related to reducing gun barrel erosion by providing an improved propelling charge for a gun system using an additive that greatly reduces gun barrel erosion. The additive, which is from about 1 weight percent to about 70 weight percent of the propelling charge, comprises an organic compound, being at least about 50 weight percent nitrogen or greater. The organic compound is included in the formulation of propelling charge. By comprising a high nitrogen content, the organic compound helps provide a high nitrogen to carbon monoxide ratio as well as reduced flame temperature of the propelling charge. These two characteristics provide greatly reduced erosion in a gun-barrel using the improved propelling charge. While the addition of the organic compound produces a slight reduction in impetus produced by the propelling charge, the improved propelling charge still produces sufficient impetus to be used in most gun systems.

DESCRIPTION OF THE PREFERRED EMBODIMENT

The invention, as embodied herein, comprises an improved propelling charge for gun systems that greatly reduces gun barrel erosion. As discussed above, when providing improved formulations of propelling charges that mitigate gun barrel erosion, such mitigation was directed solely at reducing thermal effects on the gun barrel by reducing the flame temperature of the propelling charge.

However, in conjunction with thermal effects, applicants have determined that another predominate cause of gun barrel erosion is the carburization of the gun barrel material (normally steel) that leads to iron carbide formation. In order to address this carburization phenomenon, applicants have determined that nitrogen intrusion of the iron surface of a gun barrel produces a nitriding of that surface. The nitriding prevents the carburization of the gun barrel by interfering with the disassociation of carbon monoxide on the gun barrel surface. In addition to reduction in carburization, high nitrogen organic compounds also provide a significant reduction in flame temperature when introduced into propelling charges (as much as 500 degrees), even at relatively small quantities within the formulation.

Therefore, the present invention comprises an improved propelling charge for gun systems that reduces gun barrel erosion by adding an organic compound containing about 50 weight percent or greater of nitrogen (herein after "high nitrogen organic compounds") to the propelling charge formulation. From about 1 weight percent to about 70 weight percent of the organic compound would be introduced into the formulation, depending upon the remainder of the formulation and the intended use of the propelling charge. A preferred amount of organic compound within the propelling charge is from about 10 weight percent to about 30 weight percent, with a more preferred amount being about 20 weight percent. In a preferred embodiment of the invention, the nitrogen to carbon monoxide ratio of the combustion products of the propelling charge would be about 0.5 or higher and the flame temperature of the propelling charge would be about 3800 degrees K or lower.

While the organic compound may be selected by one skilled in the art, some preferred compounds of classes include tetrazolates, azotetrazolates, tetrazines, azotetrazines, pyrazines, furazans, triazoles, pyrazoles, pyridines, triazines, or combinations thereof. The below table lists several specific examples of high nitrogen organic compounds that might be employed in the present invention.

TABLE 1

High Nitrogen Organic Compounds and Their Properties

| High Nitrogen Compound | Chemical Name | Chemical Formula | % Nitrogen | Density (g/cc) | Heat of Formation (Kcal/mole) |
|---|---|---|---|---|---|
| BTATz | Bis-tetrazol Aminotetrazine | $C_4H_4N_{14}$ | 79 | 1.76 | 211 |
| DAAT-N-Ox | Diamino-azo-tetrazine-N-Oxides Triaminoguanadinium | $C_4H_4N_{12}O_{3.5}$ | 61 | 1.9 | 152 |
| TAGzT | Azotetrazolate | $C_4H_{18}N_{22}$ | 86 | 1.6 | 256 |
| HzTz | Dihydrazinotetrazine | $C_2H_6N_8$ | 78 | 1.68 | 128 |
| GuzT | Guanadinium Azotetrazolate | $C_4H_{12}N_{16}$ | 79 | 1.54 | 98 |
| DNAT | Dinitro-azo-triazole | $C_4H_2N_{10}O_4$ | 55 | 1.88 | 97 |
| BGTz-2HNO$_3$ | Bis(Guanidinyl)Tetrazine Di-nitrate | $C_4H_{10}N_{12}O_6$ | 52 | 1.72 | −47 |

Table 1 above also provides weight percentages of nitrogen for each compound along with their densities and heats of formation. While all of the above compounds may be employed in the present invention to provide reduced gun barrel erosion as described above, the compounds having higher heats of formation values tend to provide less impedance to overall performance for the propelling charge when incorporated into the propelling charge formulation.

While the high nitrogen organic compounds may be employed to reduce gun barrel erosion in any type of propelling charge, one preferred propelling charge is a nitramine based propelling charge. Nitramine based propelling charges are those that contain a nitramine based oxidizer, such as cyclotrimethylene trinitramine (RDX), Cyclotetramethylenetetranitramine (HMX), or hexanitrohexaazaisowurtzitane (CL-20).

Nitramine based propelling charges also often include compounds providing functions such as binders, plasticizers, and stabilizers. Examples of binders include nitrocellulose, cellulose acetate butyrate (CAB), cellulose acetate, a hydroxy-terminated polybutadiene, a carboxy-terminated polybutadiene, thermoplastic elastomers, or combinations thereof. Examples of plasticizers include bis(2,2-dinitropropyl)acetyl/formal), n-butylnitratoethylnitramine, trimethylolethane trinitrate, triethylenegycol dintrate or combinations thereof. Examples of stabilizers include ethyl centralite, 2,2'-methylenebis(4-methyl-6-tertiarybutyl phenol), 2-nitrodiphenylamine of combinations thereof.

The amounts of these various constituents within a nitramine based propelling charge vary depending upon the requirement of the charge and may be selected by one skilled in the art. When the above described high nitrogen organic compound is added to a nitramine based propelling charge formulation, the following weight percentages are preferred: from about 10–80 oxidizer, from about 1–70 high nitrogen organic compound, from about 12–20 binder (with about 2–5 being nitrocellulose), from about 6–9 plasticizer, and from about 0.3–0.5 stabilizer. One exemplary formulation comprises RDX, TAGzT, CAB, nitrocellulose, bis(2,2-dinitropropyl)acetyl/formal), and ethyl centralite. One preferred embodiment of this exemplary formulation comprises the following weight percentages: about 56 RDX, about 20 TAGzT, about 12 CAB, about 4 nitrocellulose, about 7.6 bis(2,2-dinitropropyl)acetyl/formal), and about 0.4 ethyl centralite.

In the below Table 2, thermochemical data for examples of embodiments of the present invention are set forth. These formulations include the exemplary formulation described above and others that replace the high nitrogen compound TAGzT with other high nitrogen compounds disclosed above. The exemplary formulation was derived from a base propelling charge of Ex-99 (76% RDX, 12% CAB, 4% nitrocellulose, 7.6% bis(2,2-dinitropropyl)acetyl/formal), and 0.4% ethyl centralite) and replacing 20 weight percent of the RDX with TAGzT.

TABLE 2

Thermochemical Data of Formulations With High-Nitrogen Additives

| Formulation | Temp (K) | Impetus (J/g) | $N_2$/CO |
|---|---|---|---|
| Ex-99 | 3140 | 1202 | 0.640 |
| Ex-99 w/ 20% TAGzT | 2583 | 1086 | 0.802 |
| Ex-99 w/ 20% BTATz | 2690 | 1072 | 0.736 |
| Ex-99 w/ 20% DAAT-N-Ox | 3017 | 1161 | 0.703 |
| Ex-99 w/ 20% HzTz | 2867 | 1194 | 0.759 |
| Ex-99 w/ 20% GUzT | 2580 | 1070 | 0.768 |

It can be seen from the above data that all of the formulations that contain the high nitrogen organic compounds show a substantial decrease in their flame temperature and a significant increase in the nitrogen to carbon monoxide ratio in their combustion products. Also, the impetus of the formulations that contain the high nitrogen compounds only shows a slight decrease. As can be seen by the above data and information provided herein, the present invention provides a significant improvement in the area of high energy, low erosivity propellant formulations for gun systems.

EXAMPLE I

The following is an example of how one might create an embodiment of the invention described herein:

First, add 4.48 lbs. dry ground RDX and 1.60 lbs. dry TAGzT to a 2¼ gallon mixer bowl (horizontal sigma blade mixer) at ambient temperature (70–80° F.) with 0.46 lbs. of Ethanol. Close the lid of the mixer and turn the mixer blades in forward for 10 minutes. Next, add 0.432 lbs. alcohol-wet NC (12.6% Nitration, 26% TV) and 0.960 lbs. dry CAB to the mixer, close the lid and mix in forward for 10 minutes. Dissolve 0.032 lbs. of EC with 0.58 lbs. of Ethyl Acetate and add to the mixer. Close the lid and mix in forward for 10 minutes. Next, mix 0.608 lbs. of A/F with 1.24 lbs. Ethyl Acetate and add to the mixer. Turn the jacket water temperature of the mixer up to 135° F., close the lid and mix in forward for 40 minutes. Turn the jacket water temperature of the mixer down to 70° F. Attach a hose that blows air at up to 40 psi to the mixer so that the air will blow onto the mix. Turn on the air to the desired pressure and mix in forward until enough Ethyl Alcohol and Ethyl Acetate are removed and the mix is the desired consistency for extrusion. Then, turn the jacket water temperature of the mixer down to 52° F., stop the air flow to the mixer, replace the lid and mix in reverse until the mix temperature has cooled to below 80° F. Finally, remove the mix from the mixer, extrude through appropriate dies and pin plates, and granulate to the desired size(s). Dry the propellant in an oven until the Ethyl Acetate and Ethyl Alcohol are substantially removed.

What is described are specific examples of many possible variations on the same invention and are not intended in a limiting sense. The claimed invention can be practiced using other variations not specifically described above.

What is claimed is:

1. An improved propelling charge for a gun system for reducing gun barrel erosion, comprising:

a propellant formulation comprising an oxidizer; and an organic compound with a high nitrogen content, being at least about 50 weight percent nitrogen replacing a portion of the oxidizer in an amount of from about 1 weight percent to about 70 weight percent of the propellant formulation, wherein combustion products of the improved propelling charge comprise diatomic nitrogen and carbon monoxide in a ratio of about 0.5 or higher and the improved propelling charge comprises a flame temperature of about 3800 degrees K or lower;

wherein combustion of the improved propelling charge results in nitriding a surface of the gun barrel to prevent gun barrel carburization, and wherein the organic compound is selected from the group of bis-tetrazol-aminotetrazine, diamino-azotetrazine-n-oxides, dihydrazinotetrazine, guanidinium azotetrazolate, dinitro-azo-triazole, bis(guanidinyl)tetrazine di-nitrate, or combinations thereof.

2. The improved propelling charge of claim 1, wherein the oxidizer comprises a nitramine based oxidizer.

3. The improved propelling charge of claim 2, wherein the oxidizer is selected from RDX, HMX, CL-20, or combinations thereof.

4. The improved propelling charge of claim 1, wherein the improved propelling charge comprises from about 10 weight percent to about 30 weight percent of the organic compound.

5. The improved propelling charge of claim 4, wherein the improved propelling charge comprises approximately 20 weight percent of the organic compound.

6. The improved propelling charge of claim 5, further comprising a binder, a plasticizer, and a stabilizer.

7. The improved propelling charge of claim 6, wherein the binder is selected from the group of nitrocellulose, cellulose acetate butyrate, cellulose acetate, a hydroxy-terminated polybutadiene, a carboxy-terminated polybutadiene, thermoplastic elastomers, or combinations thereof.

8. The improved propelling charge of claim 6, wherein the plasticizer is selected from the group of bis(2,2-dinitropropyl)acetyl/formal), n-butylnitratoethylnitramine, trimethylolethane trinitrate, triethyleneglycol dintrate or combinations thereof.

9. The improved propelling charge of claim 6, wherein the stabilizer is selected from the group of ethyl centralite, 2,2'-methylenebis(4-methyl-6-tertiarybutyl phenol), 2-nitrodiphenylamine or combinations thereof.

10. The improved propelling charge of claim 9, further comprising RDX, guanidinium azotetrazolate, cellulose acetate butyrate, nitrocellulose, bis(2,2-dinitropropyl)acetyl/formal), and ethyl centralite.

11. The improved propelling charge of claim 10, comprising:

about 56 weight percent RDX, about 12 weight percent cellulose acetate butyrate, about 4 weight percent nitrocellulose, about 7.6 weight percent bis(2,2-dinitropropyl)acetyl/formal), about 0.4 weight percent ethyl centralite, and;

about 20 weight percent guanidinium azotetrazolate.

* * * * *